US005561413A

United States Patent [19]

Ashibe et al.

[11] Patent Number: 5,561,413

[45] Date of Patent: Oct. 1, 1996

[54] SOUND GENERATOR

[75] Inventors: Yasue Ashibe; Tadaharu Asanuma, both of Saitama, Japan

[73] Assignee: Rhythm Service Co., Ltd., Saitama, Japan

[21] Appl. No.: 368,707

[22] Filed: Jan. 4, 1995

[30] Foreign Application Priority Data

Oct. 20, 1994 [JP] Japan ..... 6-281397

[51] Int. Cl.[6] ..... G08B 3/00

[52] U.S. Cl. ..... 340/393.1; 340/392.1; 340/392.4; 340/392.5

[58] Field of Search ..... 340/384.72, 392.1, 340/393.1, 392.3, 401.1, 398.2, 392.4, 392.5, 397.1, 397.2, 396.1; 368/272, 273; 116/141, 152, 155, 156

[56] References Cited

U.S. PATENT DOCUMENTS

| | | | |
|---|---|---|---|
| 824,397 | 6/1906 | Word | 340/392.1 |
| 1,034,001 | 7/1912 | Durfee | 340/392.1 |
| 1,098,834 | 6/1914 | Oliver | 340/401.1 |
| 1,490,476 | 4/1924 | Morris | 340/392.4 |
| 1,722,983 | 7/1929 | Hammond, Jr. | 340/392.5 |
| 2,097,823 | 11/1937 | Roe | 340/392.1 |
| 2,104,963 | 1/1938 | Anderson | 340/392.4 |
| 2,247,641 | 7/1941 | Pearl | 340/392.4 |
| 2,463,380 | 3/1949 | Harris | 340/401.1 |
| 4,088,986 | 5/1978 | Boucher | 340/333 |
| 4,247,933 | 1/1981 | Nakamura | 368/269 |
| 4,286,259 | 8/1981 | Ishii . | |
| 4,357,692 | 11/1982 | Broghammer et al. | 368/250 |
| 4,358,838 | 11/1982 | Nakamura | 368/269 |

*Primary Examiner*—Brent A. Swarthout
*Attorney, Agent, or Firm*—Lowe, Price, LeBlanc & Becker

[57] ABSTRACT

The sound generator comprises a pipe gong and a hammer device for striking the pipe gong. The hammer device comprises a leaf spring whose bottom end is fixed, a hammer head installed on the upper end of the leaf spring, and a solenoid-type hammer driving device. The hammer driving device has a driving rod jointed to the leaf spring, a solenoid for driving the driving rod to stick out the front end, and a coil spring for drawing back the driving rod.

4 Claims, 7 Drawing Sheets

SOUND GENERATOR

BACKGROUND OF THE INVENTION

1. Field of the Invention

The present invention relates to a sound generator for use with music boxes, chimes, time tone generating devices of clocks, and so on.

2. Description of the Related Art

In conventional sound generators, a sounding member is struck by a hammer jointed to a cam driven by a power source of a motor, spring or weight, and so on. In a sound generator what is called "Grandfather" or "long case clock" having a time tone generating function, pipes with different lengths for different tones are hung by strings. By striking the bottom end portion of the pipes with hammer devices driven by a pin-drum or a cam, a predetermined melody is generated. After that, by striking a plurality of the pipes with other device, a time tone is generated.

In the conventional mechanical sound generators, a plurality of gears, cams and a pin-drum are required. Thus, the size of the final products will increase and the position of the sound generator should be disposed near the cams.

Moreover, in the conventional sound generator, bending and restoring of leaf springs are used for striking the pipe gongs. Therefore, the striking force is determined by the leaf spring so that it is difficult to adjust the generating sound volume. Since the gap between the hammer head and the gong is small, it is difficult to adjust the gap to control the sound volume and to prevent twice striking.

SUMMARY OF THE INVENTION

The present invention is made to solve such problems. An object of the present invention is to provide a sound generator which has a simple construction and a high degree of freedom of installation, and is easy to adjust the sound volume.

According to a first aspect of the present invention, the sound generator comprises a sounding body and a hammer device for striking the sounding body, wherein the hammer device comprises a support member, a leaf spring having a first end and a second end, the first end being secured to the support member, the second end being free, a hammer head installed to the second end of the leaf spring for striking the sounding body, a solenoid-type hammer driving device having a driving rod whose front end is jointed to a medium portion between the first end and the second end of the leaf spring, and a solenoid member for driving the driving rod in a direction as the front end sticks out to move the leaf spring, thereby the hammer head strikes the sounding body, and driving circuit means for supplying a driving signal to the solenoid member for a predetermined timing.

According to a second aspect of the present invention, the sound generator comprises a sounding body and a hammer device for striking the sounding body, wherein the hammer device comprises an arm supported at a predetermined fulcrum as being able to rotate around the fulcrum, a hammer head secured to an end point of the arm for striking the sounding body, solenoid-type hammer driving device having a driving rod whose front end is jointed to the arm and a solenoid member for driving the driving rod in a direction as the front end sticks out to move the arm, thereby the hammer head strikes the sounding body, and driving circuit means for supplying a driving signal to the solenoid member for a predetermined timing.

According to the present invention, the hammer device that strikes the sounding body is of solenoid type. The hammer head is driven by a solenoid coil so as to generate a corresponding tone. Since the hammer device is not jointed with mechanical members such as gears, cams, pin-drum, and so on, the system is simplified and the degree of freedom of installation and melodies thereof can be increased.

According to the first aspect of the present invention, the driving rod of the solenoid-type hammer driving device is driven in such a direction that the front end thereof sticks out so as to drive the hammer head through the leaf spring. Therefore, the striking force of the hammer head is determined by the driving force of the driving rod. The driving force of the driving rod is determined by the level and pattern of the driving signal supplied to the solenoid, and bending level (i.e., elasticity) of the leaf spring. In this case, it is able to generate a large sound by use of the bending of the leaf spring. Since the level and pattern of the driving signal can be adjusted easily, it is able to control the sound volume as somebody hears the sound.

Further, in the sound generator of the present invention, the hammer head is apart from the sounding body in a steady state. When the signal supplying is stopped after the sounding body is struck, the driving rod is drawn back by the leaf spring so that the hammer head moves to be separated from the sounding body. Therefore, twice striking can be prevented, and it becomes unnecessary to finely adjust the gap.

If the arm is stiff in the sound generator according to the second aspect of the present invention, it is not expected to increase the striking force by the above-mentioned bending. However, in this case, the striking force is determined by the driving force of the solenoid only, the sound volume can be more easily controlled.

DESCRIPTION OF PREFERRED EMBODIMENTS

Next, with reference to the accompanying drawings, embodiments of the present invention will be described.

Figure 1:
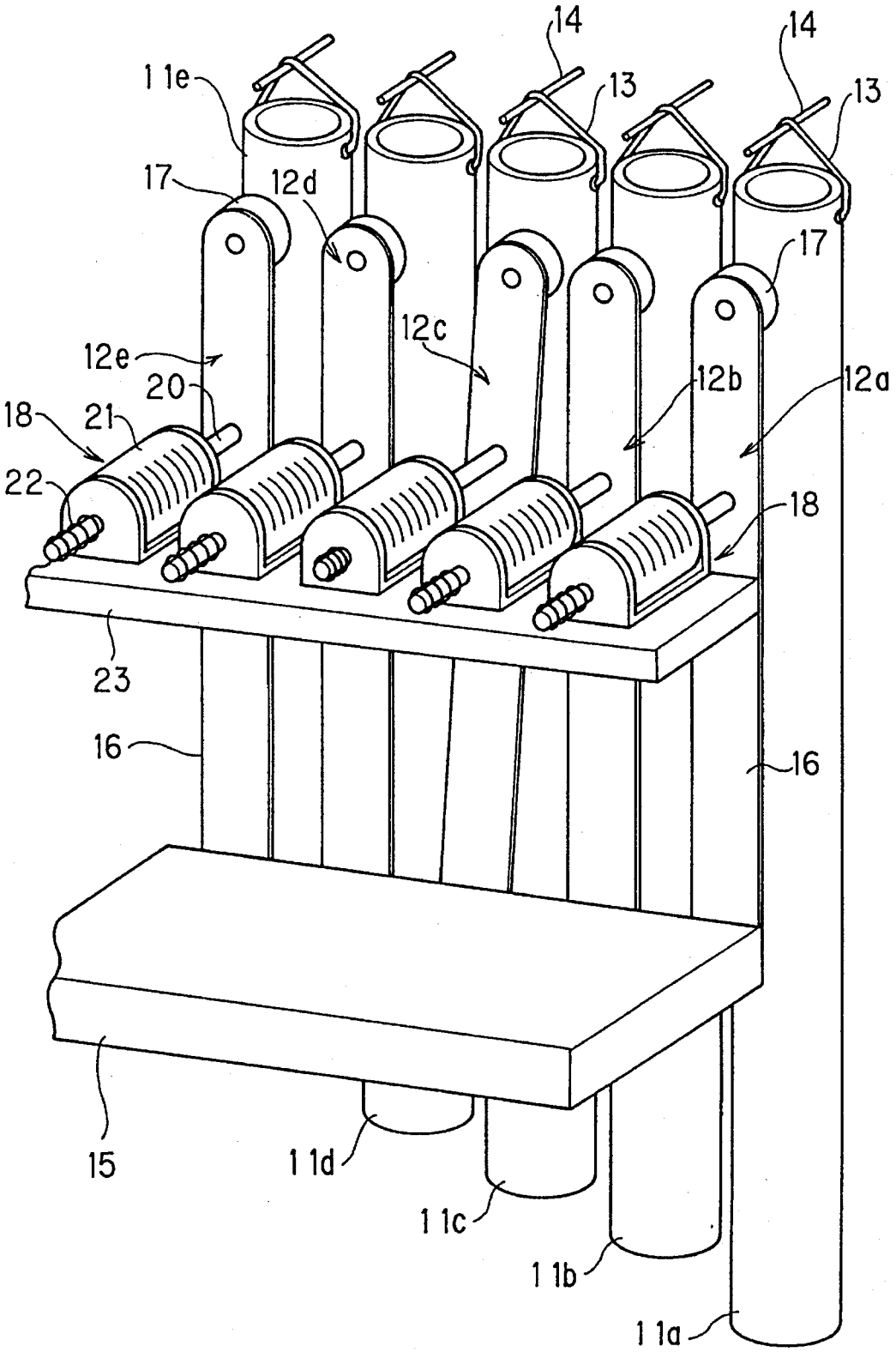
FIG. 1 is a perspective view showing main portions of a sound generator according to an embodiment of the present invention.
Figure 2:
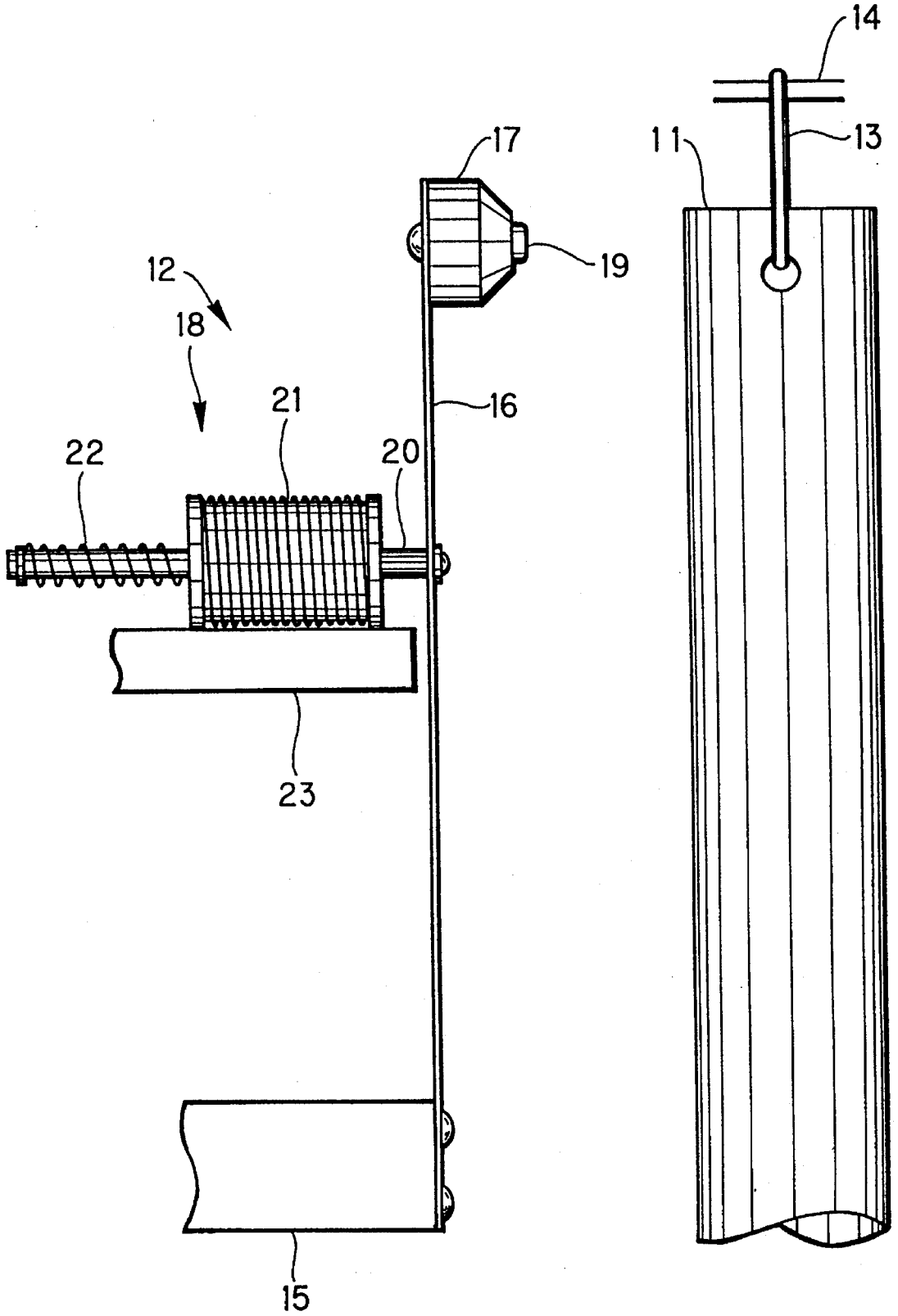
FIG. 2 is a side view showing a part of the generator of FIG. 1.

As shown in FIG. 1, the sound generator comprises a plurality of pipe gongs 11*a* to 11*e* and a plurality of hammer devices 12*a* to 12*e*. Each of the hammer devices is arranged to be opposed to each of the pipe gongs 11*a* to 11*e*, respectively. The pipe gongs 11*a* to 11*e* are made of metal such as iron, phosphor bronze or the like, or glass to have different lengths for corresponding tones. The pipe gongs 11*a* to 11*e* are hung from support pins 14 by strings or cords 13 to be aligned parallel each other. Each of the hammer devices 12*a* to 12*e* comprises a leaf spring 16 which is made of stainless steel and the bottom end thereof is secured to a support member 15, a hammer head 17 for striking the pipe gong 11, and a solenoid-type hammer driving device 18. Each of the hammer heads 17 is made of brass, and installed on the upper end of the leaf spring 16 to be opposed to the upper portion of the pipe gongs 11. The leaf springs 16 are arranged parallel each other to be opposed to each corresponding pipe gongs 11*a* to 11*e* with a predetermined gap a. On a front face of each of the hammer heads 17, shock absorbing member 19 is installed, which is made of synthetic resin, for example, plastics, POM or the like.

Each of the hammer devices 18 is constructed of a driving rod 20, a solenoid coil 21 for driving the driving rod 20 in a direction as the front end sticks out when a predetermined electric signal is supplied, and a coil spring 22. The driving rod 20 is made of a magnetic material and is jointed to a certain portion of the leaf spring 16 between the fixed bottom end and the upper end, in a direction perpendicular to the leaf spring 16. The solenoid coil 21 is disposed around the driving rod 20 and is secured to a support member 23. The coil spring 22 is disposed between a rear end portion of the driving rod 20 and the solenoid coil 21, and always draws back the driving rod 20 in a direction as the hammer head 17 is separated from the pipe gong 11.

Figure 3:
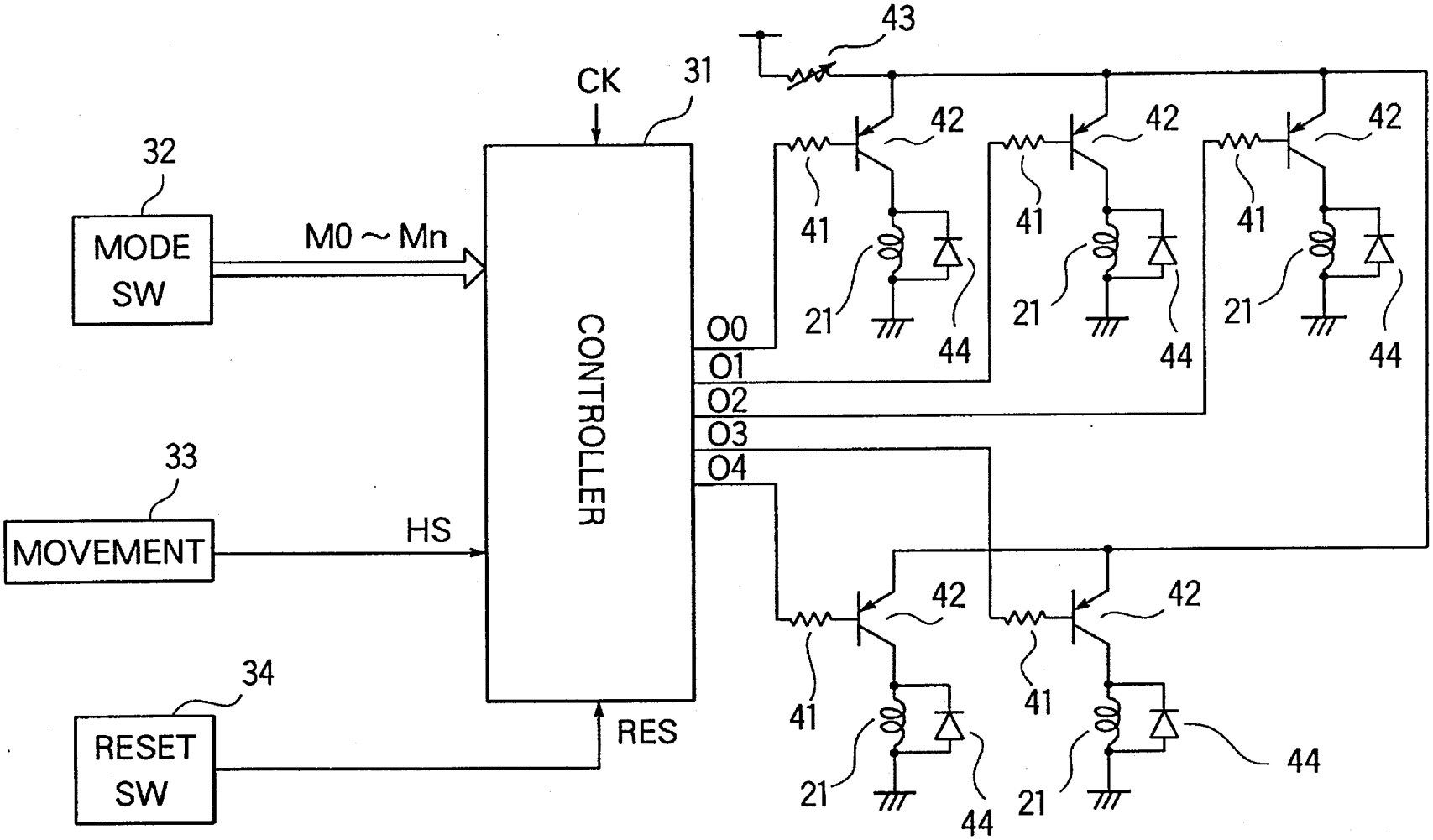
FIG. 3 is a schematic diagram showing a circuit construction of the sound generator of FIG. 1.

FIG. 3 is a schematic diagram showing a sound control circuit that supplies current to the hammer devices 12*a* to 12*e*. This circuit is used for a striker of a clock.

The control circuit 31 sets modes with mode signals M0 to Mn corresponding to music programs, time tone range, or the like that are designated by a mode switch 32. When the control circuit 31 receives a time tone start signal HS from a movement 33 of a clock (quartz) every 1 hour, 30 minutes, or 15 minutes, the control circuit 31 outputs sound signals 00, 01, 02, 03, and 04 corresponding to the designated mode. The sound signals 00 to 04 are supplied to respective bases of PNP transistors 42 through registers 41. Each collector of the transistor 42 is connected to each of solenoid coils 21, and emitters are commonly connected to power supply through a variable resister 43. The transistors 42 supply respective collector current (pulse current) to the solenoid 21 of the hammer devices 12*a* to 12*e*. Thus, the hammer devices 12*a* to 12*e* are selectively tensioned and the corresponding pipe gong 11 are struck.

By controlling the variable resisters 43 connected in series to the emitter of the transistor 42, the pulse current supplied to the solenoids 21 is variably controlled, thereby sound volume is controlled. Diodes 44 that are reversely connected in parallel with the respective solenoid 21 prevent overvoltage generating from the solenoid 21. A reset switch 34 is used to initialize the control circuit 31.

When the control circuit 31 is constructed of a microcomputer, a microprogram stored in an ROM (not shown) of the microcomputer is activated with the time tone start signal HS so as to generate sound signals. The mode signals M0 to Mn designate a start address of a microprogram to be selected.

Figure 4:
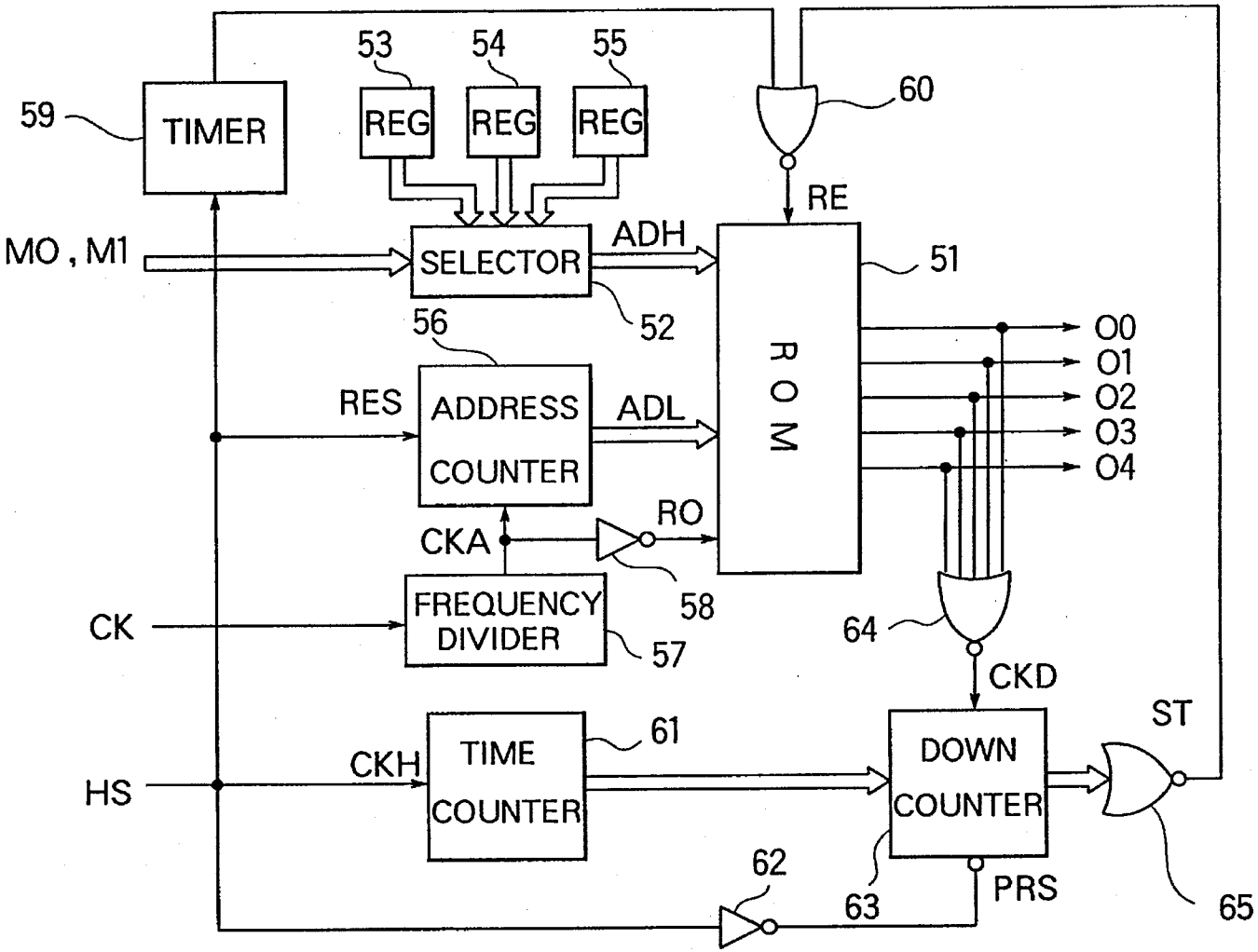
FIG. 4 is a block diagram showing a construction of a control circuit of the sound generator of FIG. 1.

When the control circuit 31 is constructed of hardware, the construction will be as shown in FIG. 4.

In FIG. 4, a ROM 51 stores time sequence data of sound signals 00 to 05 corresponding to a plurality of music programs. A selector 52 selects information representing a high order address of a location where information of a music program designated with the mode signals M0 and M1 is stored from a plurality of registers 53, 54, and 55. The registers 53, 54, and 55 output a high order address ADH to the ROM 51. An address counter 56 is reset with the time tone start signal HS. The address counter 56 counts pulses of an address clock CKA where the frequency of a reference clock CK is divided by a frequency divider 57. The address counter 56 outputs a low order address ADL to the ROM 51. An address clock CKA determines the tempo of a time tone (namely, the read interval of the ROM 51), and is supplied to the ROM 51 through an inverter 58 as a read out signal RO.

When the time tone start signal HS is supplied to the timer 59, the output signal thereof becomes low for 1 to 2 minutes. This signal is supplied to a NOR gate 60. The NOR gate 60 outputs a read enable signal RE to the ROM 51.

The time tone start signal HS supplied to a time counter 61 as a time count clock CKH. The time counter 61 counts 1 to 12 every hour. An output of the time counter 61 is preset to a down-counter 63 with an output signal of an inverter 62 in which the time tone start signal HS is supplied. A NOR gate 64 detects a time tone following a chime sound [namely, a sound signal where all sound signals 00 to 05 become active (L level)]. The down-counter 63 counts an output signal of the NOR gate 64. When the value of the down-counter 63 becomes 0, it outputs a sound stop signal ST through a NOR gate 65. The sound stop signal ST is supplied to a NOR gate 60. The NOR gate 60 outputs a read enable signal RE to the ROM 51.

Figure 5A:
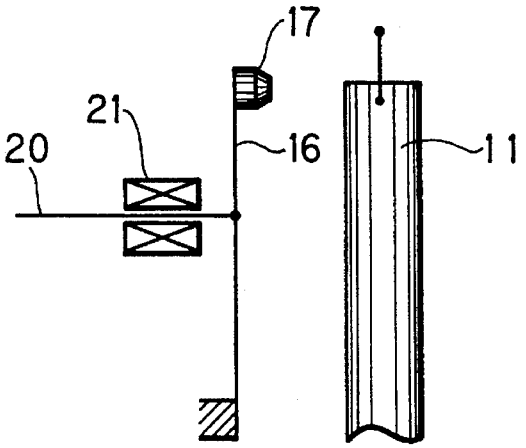
FIGS. 5*a* to 5*d* are drawings for explaining the operation of the sound generator.
Figure 5B:
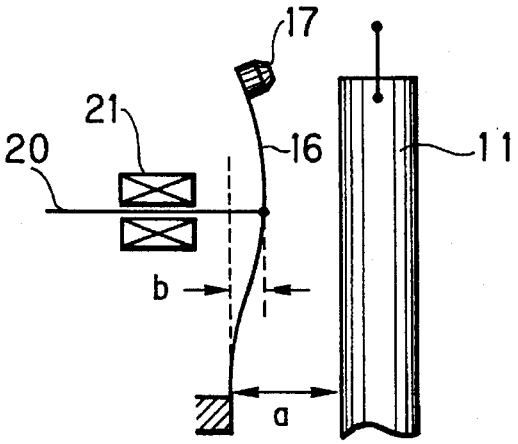
Figure 5C:
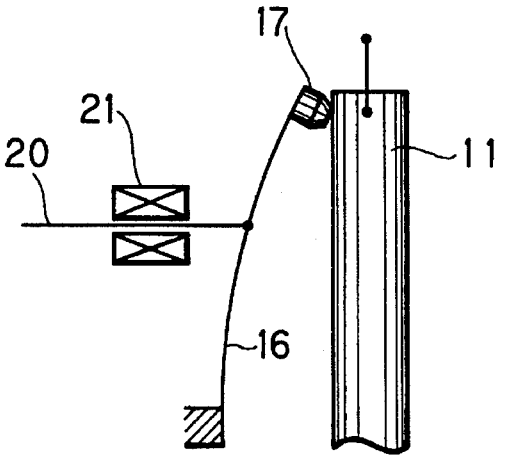
Figure 5D:
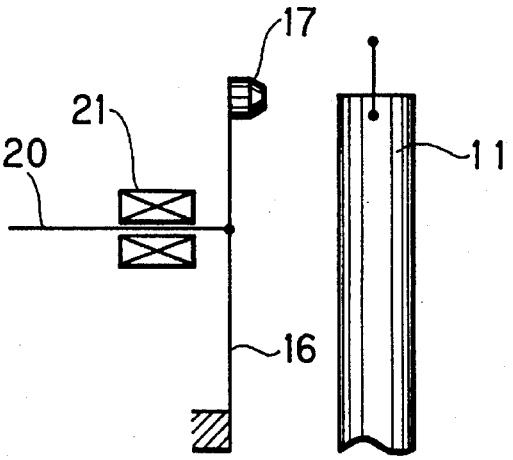

Next, referring to FIG. 5A to 5D, the operation of the sound generator will be described. FIG. 5A shows a steady state while the solenoid 21 is not driven. When the control circuit 31 supplies a predetermined electric signal to each solenoid 21 of the hammer devices 12, as shown in FIG. 5A, the driving rod 20 instantaneously sticks out in a forward direction, thereby the hammer head 17 is driven toward the pipe gong 11. At the same time, the leaf spring 16 bends. The sticking length b is decided by the driving condition of the solenoid 21, the tensile strength of the spring 22, and the elasticity of the leaf spring 16, and so on. In this embodiment, the sticking length b is limited to be smaller than the gap a between the leaf string 16 and the pipe gong 11. As shown in FIG. 5C, after the signal supplying to the solenoid 21 is stopped, the hammer head 17 strikes the pipe gong 11 by the elastic force of the leaf spring 16. Then, as shown in FIG. 5D, the leaf spring 16 rapidly return backward by the elastic force of the leaf spring 16 and the spring 22.

According to the above-described embodiment, by use of the combination of the driving of the solenoid 21 and the elastic force of the leaf spring 16, the pipe gong 11 is strictly struck, thereafter the leaf spring 16 draws back rapidly. Therefore, such a phenomenon that the pipe gong 11 is struck once and again can be prevented. In this device, the fine adjustment of the gap between the hammer head 17 and the pipe gong 11 is not required, because the gap can be set to be large. Further, the sound volume can be easily controlled by the variable control of the current supplied to the transistor 42 to control the sticking length and the speed of the driving rod 21. Since the hammer device is not connected to such mechanical members as cams, the size thereof can be decreased. If it is able to prevent the twice striking by the elastic force of the leaf spring 16 only, the spring 22 can be omitted.

Figure 6:
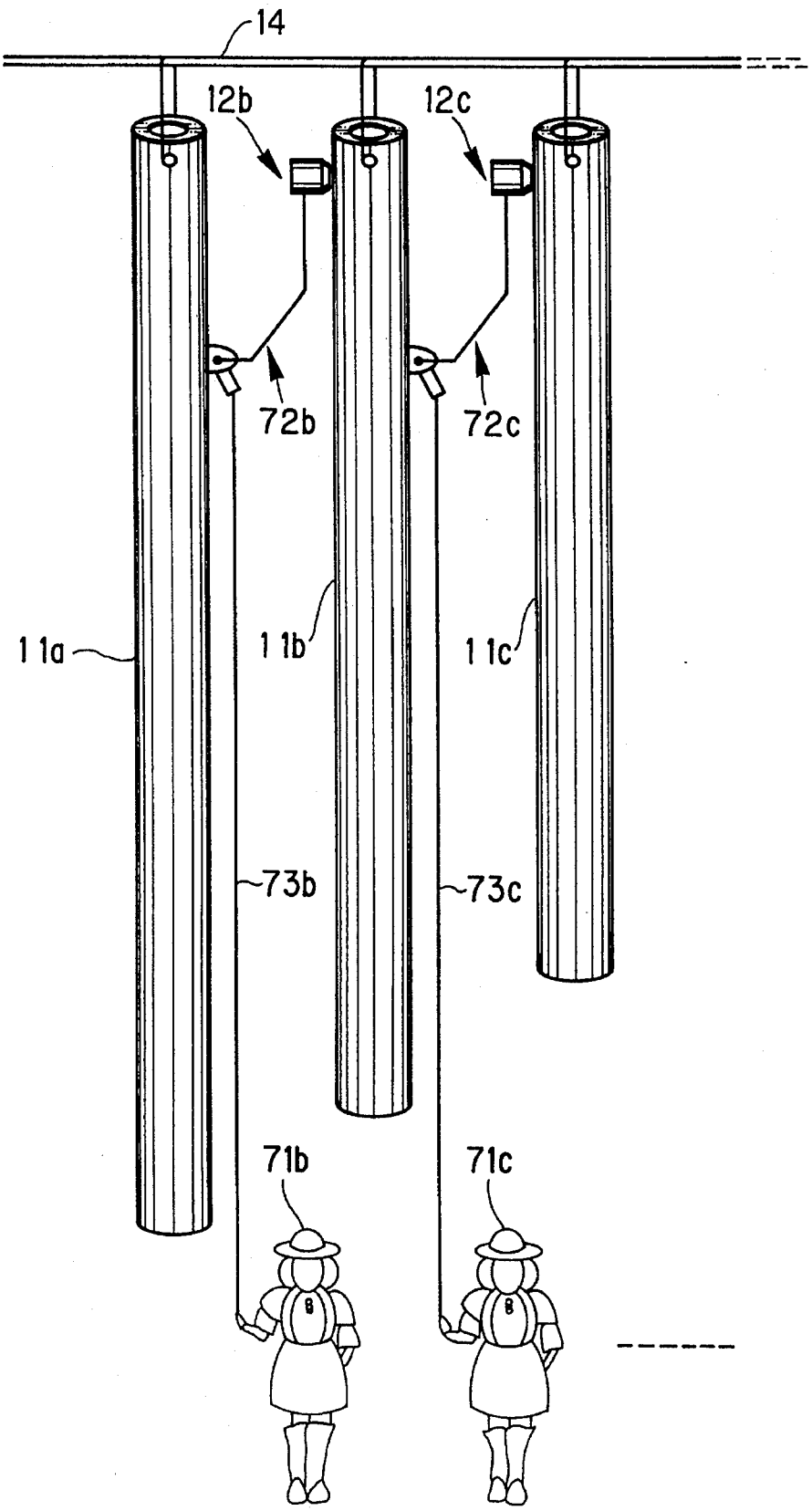
FIG. 6 is a perspective view showing main portions of a sound generator according to another embodiment of the present invention.

FIG. 6 shows the construction of the sound generator according to another embodiment of the present invention.

As same as the above-mentioned embodiment, the sound generator comprises a plurality of pipe gongs 11*a* to 11*e* having different lengths for corresponding tones each other, and a plurality of hammer devices 12*a* to 12*e*, each of them being arranged to be opposed to each of the pipe gongs 11*a* to 11*e*, respectively. In this embodiment, dolls 71 which are pretended to be operators are arranged. Each of the dolls 71 is holding one end of each of string 73 , the other end thereof being connected to each of arms 72. For the purpose of showing that the dolls 71 are like as if operators of the device, each of the main portion of the hammer devices 12 is placed behind neighboring pipe gong 11 to be hidden out of sight.

Figure 7:
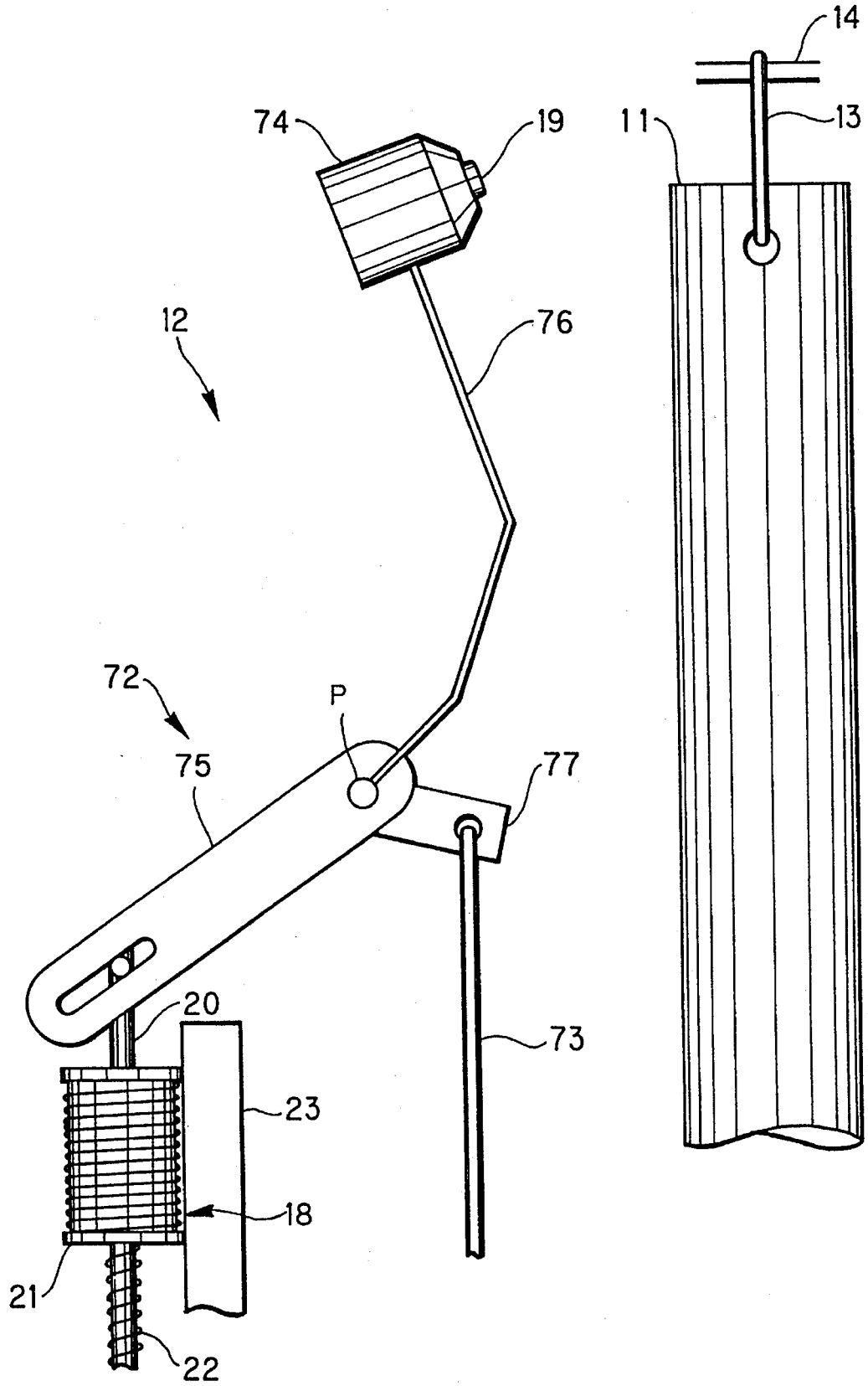
FIG. 7 is a side view showing a part of the generator of FIG. 6.

As shown in FIG. 7, each of the hammer device 12 comprises an arm 72 supported at a predetermined fulcrum as being able to rotate around the fulcrum, a hammer head 19 secured to an end point of the arm 72 for striking the pipe gong 11 made of brass, and a solenoid-type hammer driving device 18.

The hammer driving device 18 has a driving rod 20 whose front end is jointed to the arm 72 and a solenoid member 21 for driving the driving rod 20 in a direction as the front end sticks out to move the arm 72, thereby the hammer head 19 strikes the pipe gong 11, and a coil spring 22 for always drawing back the driving rod 20 in a direction as the hammer head 19 is separated from the pipe gong 11. The arm 72 comprises a transmitting rod 75 whose front end is jointed to the driving rod 20, a wire 76 made of stainless steel and jointed to the transmitting rod at a fulcrum P, and a support member 73 for hanging the string 73, which is jointed to the transmitting rod 75 at the fulcrum P. The shape of the wire 76 is designed to take a predetermined gap between the hammer head 74 and the pipe gong 11. A driving circuit supplies (not shown), as same as above-described embodiment, a driving signal to the solenoid member 21 for a predetermined timing.

As above described, since the degree of freedom of the device installation is high, it is able to provide such a sound generator that the dolls move together with the driving members.

In the above-described embodiments, a pipe gong is used as a sounding body. The present invention can be applied to other devices in which, for example, a bell-type sounding body is used.

As described above, according to the present invention, the hammer device for striking the sounding body is solenoid-type, and drives the hammer head by the solenoid coil to generate sound. Therefore, the size of the hammer device is decreased, because such mechanical members as cams are not necessary to be connected.

Further, in the present invention, the striking force of the hammer head is decided by the level and the pattern of the signal supplied to the solenoid. Therefore, the sound volume is easily controlled.

Moreover, according to the present invention, the hammer head is set to be apart from the sounding body in the steady state. The hammer head strikes the sounding body by aid of the leaf spring, thereafter is drawn back by the elastic force of the leaf spring. Therefore, the double striking of the sounding body is effectively prevented, and it is not necessary of fine gap adjustment.

What is claimed is:

1. A sound generator, comprising a plurality of sounding bodies arranged in parallel with each other with a gap therebetween and a plurality of hammer devices each of which being arranged to be opposed to each of said sounding bodies for striking the respective sounding body, said sounding bodies and said hammer devices being installed in a case, each of said hammer devices comprising:

an arm supported at a predetermined fulcrum as being able to rotate around said fulcrum;

a hammer head secured to an end point of said arm for striking the respective sounding body;

a solenoid-type hammer driving device installed in the case and having a driving rod whose front end is jointed to said arm and a solenoid member for driving said driving rod in a direction as said front end sticks out to move said arm, thereby said hammer head strikes the respective sounding body;

driving circuit means for supplying a driving signal to said solenoid member for a predetermined timing;

wherein each of said arms and each of said hammer heads is arranged and exposed for viewing in the gap between adjacent sounding bodies each said solenoid-type hammer driving means is placed behind a respective said sounding body so that each solenoid-type hammer driving means is hidden from view, and further comprising a plurality of dolls, each of which is connected to the respective arm by a string, each doll arranged in the gap between adjacent sounding bodies.

2. The sound generator according to claim 1, wherein said driving circuit means comprises:

a transistor for supplying a current pulse to drive said solenoid member; and a variable resistor connected in series to said transistor for controlling the value of said current pulse.

3. The sound generator according to claim 1, wherein said hammer driving device has a coil spring for drawing said driving rod in a direction backward thereof.

4. The sound generator of claim 1 wherein said driving circuit means controls the speed of the driving rod.

* * * * *